US006227075B1

(12) United States Patent
Carmien

(10) Patent No.: US 6,227,075 B1
(45) Date of Patent: May 8, 2001

(54) NONRECOIL HAMMER

(76) Inventor: Joseph Allen Carmien, 525 N. Maple Dr., Beverly Hills, CA (US) 90210

( * ) Notice: Subject to any disclaimer, the term of this patent is extended or adjusted under 35 U.S.C. 154(b) by 0 days.

(21) Appl. No.: 09/236,851

(22) Filed: Jan. 25, 1999

(51) Int. Cl.[7] ..... B25D 1/12

(52) U.S. Cl. ..... 81/22

(58) Field of Search ..... 81/20, 22; 30/308.1

(56) References Cited

U.S. PATENT DOCUMENTS

| | | |
|---|---|---|
| Re. 32,364 | 2/1987 | Carmien . |
| 404,663 | 6/1889 | Thompson et al. . |
| 657,422 | 9/1900 | Judd . |
| 894,155 | 7/1908 | Layton . |
| 1,374,336 | 4/1921 | Surbaugh . |
| 1,435,851 | 11/1922 | Isham . |
| 1,755,236 | 4/1930 | Brandenburg . |
| 2,031,556 | 2/1936 | Brandenburg . |
| 2,052,616 | 9/1936 | Gardes . |
| 2,063,774 | 12/1936 | Washington . |
| 2,205,769 | 6/1940 | Sweetland . |
| 2,238,104 | 4/1941 | Finley . |
| 2,517,902 | 8/1950 | Luebkeman . |
| 2,837,381 | 6/1958 | Sarlandt . |
| 2,850,331 | 9/1958 | Curry et al. . |
| 2,948,649 | 8/1960 | Pancherz . |
| 3,018,140 | 1/1962 | Portz et al. . |
| 3,232,355 | 2/1966 | Woolworth . |
| 3,549,189 | 12/1970 | Alosi . |
| 3,556,888 | 1/1971 | Goldsworthy . |
| 3,620,159 | 11/1971 | Gould . |
| 3,753,602 | 8/1973 | Carmien . |
| 3,762,453 | 10/1973 | Merrow et al. . |
| 3,819,288 | 6/1974 | Carmien . |
| 3,874,433 | 4/1975 | Shepherd, Jr. et al. . |
| 3,877,826 | 4/1975 | Shepherd, Jr. et al. . |
| 3,915,782 | 10/1975 | Davis et al. . |
| 3,917,421 | 11/1975 | Carmien et al. . |
| 4,030,847 | 6/1977 | Carmien . |
| 4,039,012 | 8/1977 | Cook . |
| 4,050,727 | 9/1977 | Bonnes . |
| 4,085,784 | 4/1978 | Fish . |
| 4,139,930 | 2/1979 | Cox . |
| 4,287,640 | 9/1981 | Keathley . |
| 4,291,998 | 9/1981 | Santos . |
| 4,367,979 | 1/1983 | Milligan . |
| 4,404,708 | 9/1983 | Winter . |
| 4,424,183 | 1/1984 | Nelson . |

(List continued on next page.)

FOREIGN PATENT DOCUMENTS

| | | |
|---|---|---|
| 1064418 | 5/1954 | (FR) . |
| 2555098A | 5/1985 | (FR) . |
| 3424 | of 1882 | (GB) . |
| 1376180 | 1/1972 | (GB) . |
| 2093398A | 9/1982 | (GB) . |
| 129611 | 10/1950 | (SE) . |
| PCT/SE84/0036 | 8/1984 | (WO) . |

*Primary Examiner*—D. S. Meislin
(74) *Attorney, Agent, or Firm*—Kelly Bauersfeld Lowry & Kelley, LLP

(57) ABSTRACT

An improved nonrecoil or deadblow hammer and related production method are provided, wherein the hammer has a tool head of hardened steel or the like formed with a hollow socket containing a flowable filler material adapted to absorb or dissipate shock forces and thereby substantially reduce or eliminate rebound when an impact blow is struck by the hammer. The tool head comprises a central body having, for example, a conventional impact member and a nail removal claw formed at opposite ends thereof. The hollow socket is formed in the central body and is upwardly open for seated reception of a hollow canister containing the flowable filler material, such as small steel pellets. In the preferred form, the canister is preassembled with a tool handle which extends downwardly from the tool head through a handle port formed at the base or lower end of the socket.

32 Claims, 3 Drawing Sheets

U.S. PATENT DOCUMENTS

| | | | | |
|---|---|---|---|---|
| 4,451,073 | | 5/1984 | Carmien . | |
| 4,570,988 | | 2/1986 | Carmien . | |
| 4,605,254 | | 8/1986 | Carmien . | |
| 4,639,029 | | 1/1987 | Kolonia . | |
| 4,697,481 | | 10/1987 | Maeda . | |
| 4,743,481 | | 5/1988 | Quinlan et al. . | |
| 4,831,901 | * | 5/1989 | Kinne | 81/20 X |
| 5,031,272 | | 7/1991 | Carmien . | |
| 5,056,381 | | 10/1991 | Carmien . | |
| 5,123,304 | | 6/1992 | Carmien . | |
| 5,262,113 | | 11/1993 | Carmien . | |
| 5,375,486 | | 12/1994 | Carmien . | |
| 5,537,896 | * | 7/1996 | Halder | 81/22 X |
| 5,916,338 | * | 6/1999 | Bergkvist et al. | 81/22 |
| 5,960,677 | * | 10/1999 | Carmien | 81/22 |

* cited by examiner

NONRECOIL HAMMER

BACKGROUND OF THE INVENTION

This invention relates generally to improvements in impact type hand tools such as hammers and mallets and the like, and to related processes for manufacturing such hand tools. More particularly, this invention relates to an improved hammer of the type having a tool head of hardened steel or the like, such as a carpenter's framing hammer, wherein the tool head contains a flowable filler material to provide the hammer with nonrecoil or deadblow characteristics during normal use.

Hammers of the type have a tool head defining one or more metal impact members are well known in the art, for use in striking a target or work surface. In this regard, such hammers are available in a broad range of tool head sizes, shapes and weights in accordance with the particular task or tasks to be performed, such as driving nails or breaking concrete. Since marking or other damage to the target surface is frequently not an issue, the tool head is commonly constructed from a tough grade and preferably hardened steel to provide durable impact members for extended service life. One example of such hammers comprises a conventional carpenter's framing hammer having a hardened steel tool head with a central aperture or eyehole for assembly with a tool handle, wherein the tool head defines an impact member and a nail removal claw at opposite ends thereof. The tool head of such framing hammer is used for a variety of tasks, including driving nails, removal of nails, and other prying and wedging functions.

One problem encountered with traditional hammers of the type having a metal tool head relates to hammer rebound or recoil from a target surface after striking an impact blow. More specifically, when the hammer is swung by a worker to strike a target surface, most of the kinetic energy is transmitted from the impact member of the hammer to the target surface at the moment of impact. However, a portion of this kinetic energy is not transmitted to the target surface, but instead causes the hard-faced tool head to rebound or recoil from the target surface. This rebound effect thus prevents complete or substantially complete energy transfer to the target surface, thereby typically requiring an increased number of impact blows to perform a given task, e.g., driving a nail. Alternately, this rebound effect requires the worker to swing the hammer with an increased force, or to use a hammer with a heavier tool head, in order to complete a task with a reduced number of impact blows. Moreover, the worker must maintain a grasp of the hammer following an impact blow with sufficient strength to resist rebound forces in order to prevent loss of control. All of these factors undesirably increase the degree of strength and skill required for proper and safe hammer usage.

Nonrecoil or so-called deadblow hammers have been developed in an attempt to reduce or eliminate rebound of the tool head from a target surface following an impact blow. Such nonrecoil or deadblow hammers typically have a tool head defined by a hollow core canister filled partially with a relatively high mass and flowable filler material such as steel shot pellets, steel pins, or the like. In many designs, the hollow canister is protectively encased in whole or in part within a molded jacket or cladding constructed from a selected tough and durable thermoplastic material such as nylon. In use, when the tool head is impacted with a target surface, the filler material shifts and slides about within the hollow canister to absorb and dissipate the impact force in a manner which effectively counteracts any resultant rebound force. As a result, a greater proportion of the kinetic energy is transmitted from the tool head to the target surface in the course of each blow, to permit performance of a given task in a reduced number of blows, or alternately to permit use of a hammer having a lighter tool head. In addition, less strength and skill are required to control the hammer following each blow. For examples, of such nonrecoil impact tools, see U.S. Pat. Nos. 5,262,113 and 5,375,486. However, nonrecoil hammers have generally been limited to mallets and the like having relatively soft impact faces designed to avoid marking or damage to the target surface, or alternately to include metal-faced caps designed to mount upon a tool head formed primarily from relatively soft or nonmetallic materials. Such hammers have generally been ill-suited for use, for example, in a typical carpentry or framing environment wherein a hardened steel tool head is desired.

The present invention relates to an improved hammer or other striking tool of the type having a rigid tool head of hardened steel or the like to define at least one hard-faced impact member, wherein the tool head contains a flowable filler material of relatively high mass to provide the hammer with substantial nonrecoil characteristics following an impact blow to a target surface.

SUMMARY OF THE INVENTION

In accordance with the invention, an improved nonrecoil or deadblow hammer and related production method are provided, wherein a tool head of hardened steel or the like is formed with a hollow socket containing a flowable and relatively high mass filler material adapted to absorb or dissipate shock forces and thereby substantially reduce or eliminate rebound when an impact blow is struck by the hammer. The tool head comprises a central body having at least one impact member formed thereon for striking a target surface, wherein the central body has the hollow socket formed therein for seated reception of a hollow canister containing the flowable filler material, such as small steel pellets. The canister may be preassembled with a tool handle which extends downwardly from the tool head through a handle port formed at the base or lower end of the socket.

More specifically, in accordance with a preferred form of the invention, the tool head formed from hardened steel or the like defines the hollow socket which opens upwardly for nested and substantially seated reception of the hollow canister containing the flowable filler material. The canister defines an opposing pair of end faces seated respectively in substantial abutting relation with a matingly shaped pair of end walls lining the opposite ends of the socket. These end walls within the socket are formed respectively at the inboard sides of front and rear tool work members, such as a front impact member and a cleft-shaped rear nail removal claw in the case of a carpenter's framing hammer.

The canister is preferably preassembled with a tool handle which in one form may be constructed as a fiberglass pultrusion and then assembled with the canister as by encasing all or part of the canister and handle within a suitable thermoplastic molded cladding. Such hollow canister preassembled with a tool handle is shown and described, for example, in U.S. Pat. Nos. 5,262,113 and 5,375,486, which are incorporated by reference herein. The canister is partially filled with the flowable filler material, and seated within the upwardly open socket formed in the tool head. In this position, the tool handle extends downwardly from the tool head through the handle port formed in the base or lower end of the socket. Lock means such as a cap plate may be attached to the tool head for enclosing and retaining the canister within the socket.

In use, upon swinging of the hammer to strike one of the took work members such as the front impact member against a target surface, the flowable filler material within the canister shifts in the direction of the impact blow to absorb and dissipate shock forces in a manner which focuses the impact energy upon the target surface while reducing or eliminating any significant rebound. In this regard, the canister containing the filler material is tightly constrained within its opposite end faces seated against the inboard end walls of the tool head lining the socket, resulting in efficient energy transfer between the canister and the tool head.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
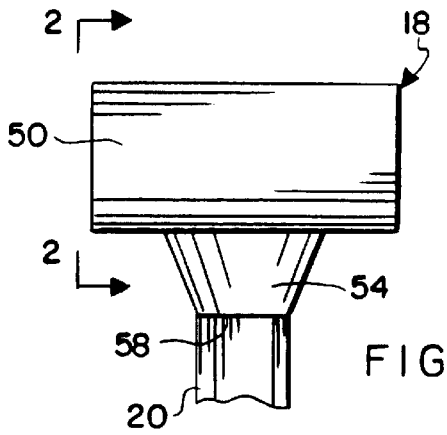
FIG. 1 is a fragmented side elevational view depicting a hollow canister preassembled with a tool handle, for use in constructing the improved nonrecoil hammer of the present invention.
Figure 2:
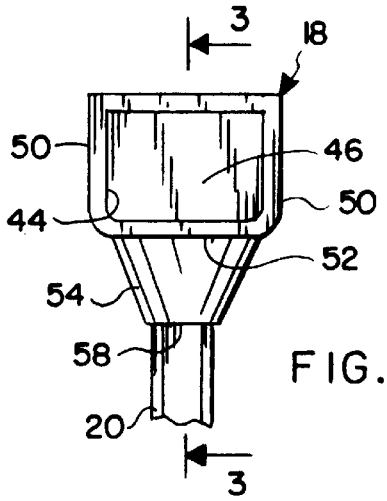
FIG. 2 is a fragmented front elevational view of the preassembled canister and tool handle of FIG. 1, taken generally on the line 2—2 of FIG. 1.
Figure 3:
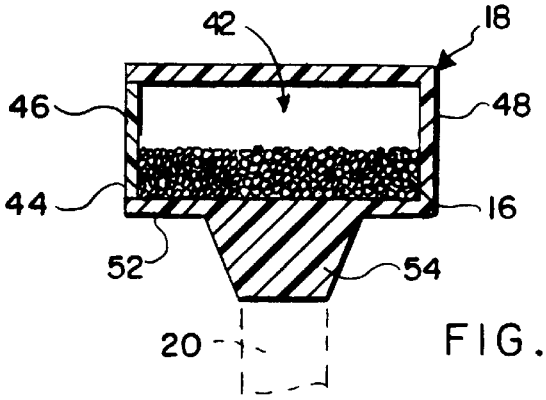
FIG. 3 is a fragmented longitudinal vertical sectional view of the preassembled canister and tool handle, taken generally on the line 3—3 of FIG. 2.
Figure 4:
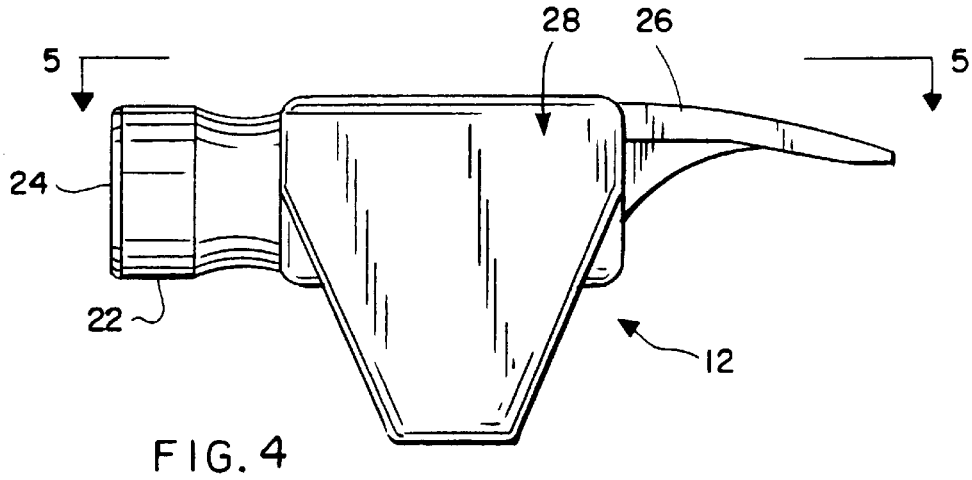
FIG. 4 is a side elevational view of a tool head, for use in constructing the improved nonrecoil hammer of the present invention.
Figure 5:
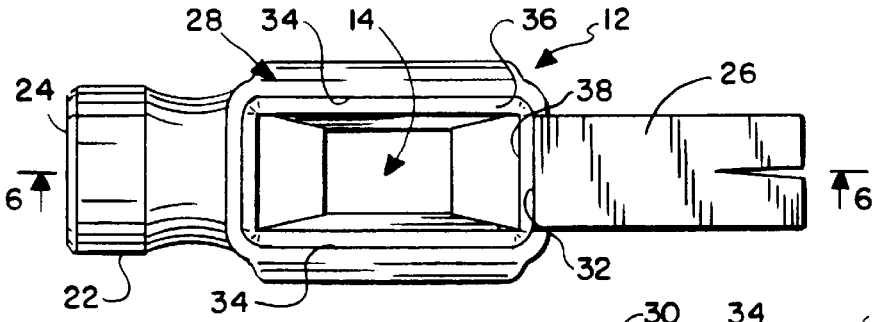
FIG. 5 is a top plan view of the tool head of FIG. 4, taken generally on the line 5—5 of FIG. 4.
Figure 6:
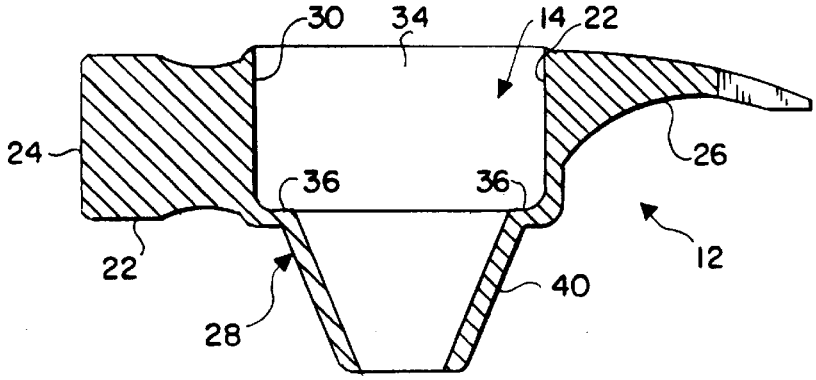
FIG. 6 is a longitudinal vertical sectional view of the tool head, taken generally on the line 6—6 of FIG. 5.
Figure 7:
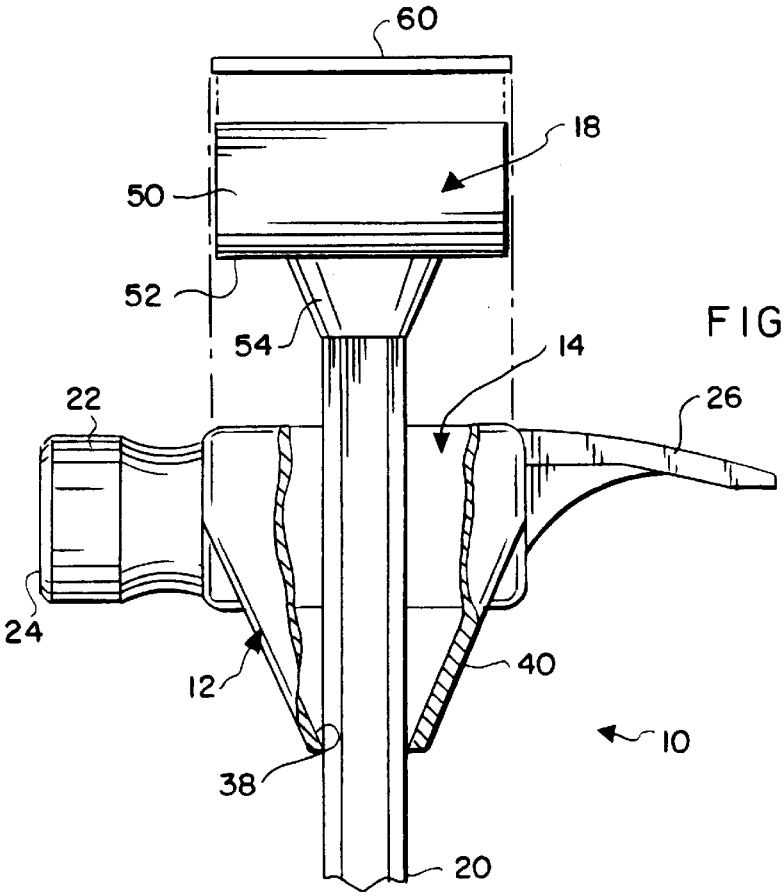
FIG. 7 is an exploded and fragmented side elevational view illustrating assembly of the canister and tool handle with the tool head.
Figure 8:
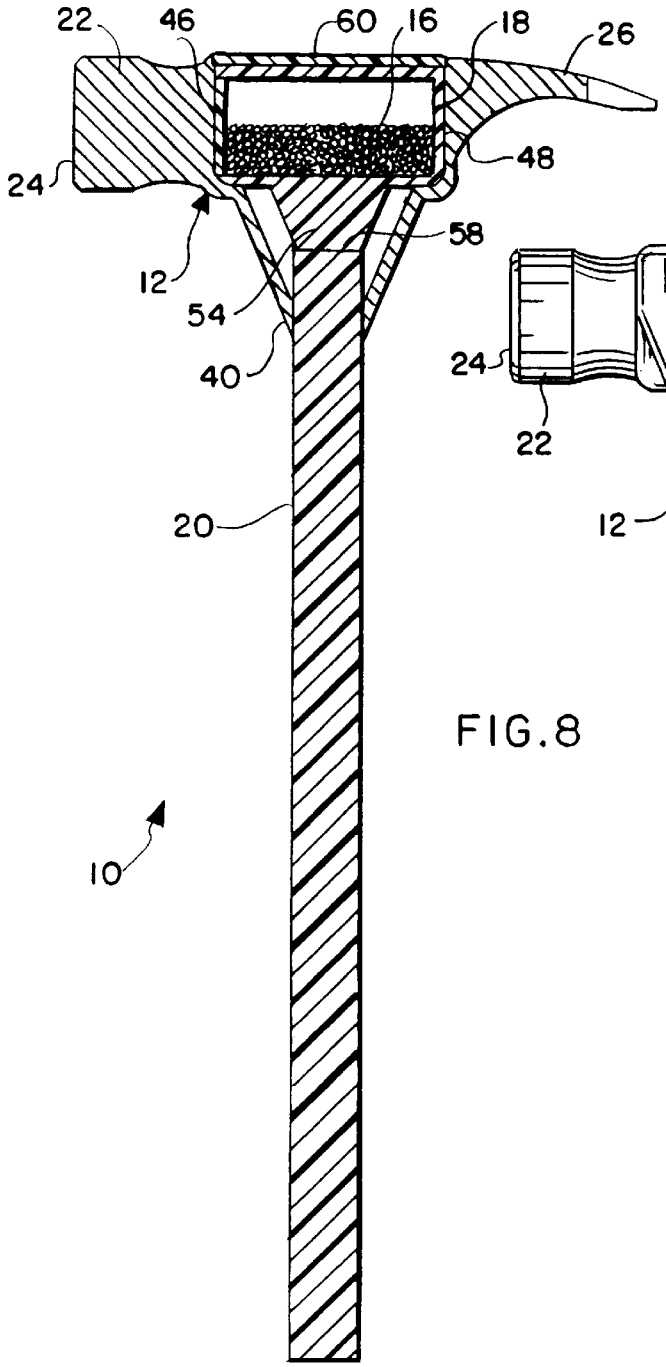
FIG. 8 is a vertical sectional view illustrating the canister and tool handle in assembled relation with the tool head.
Figure 9:
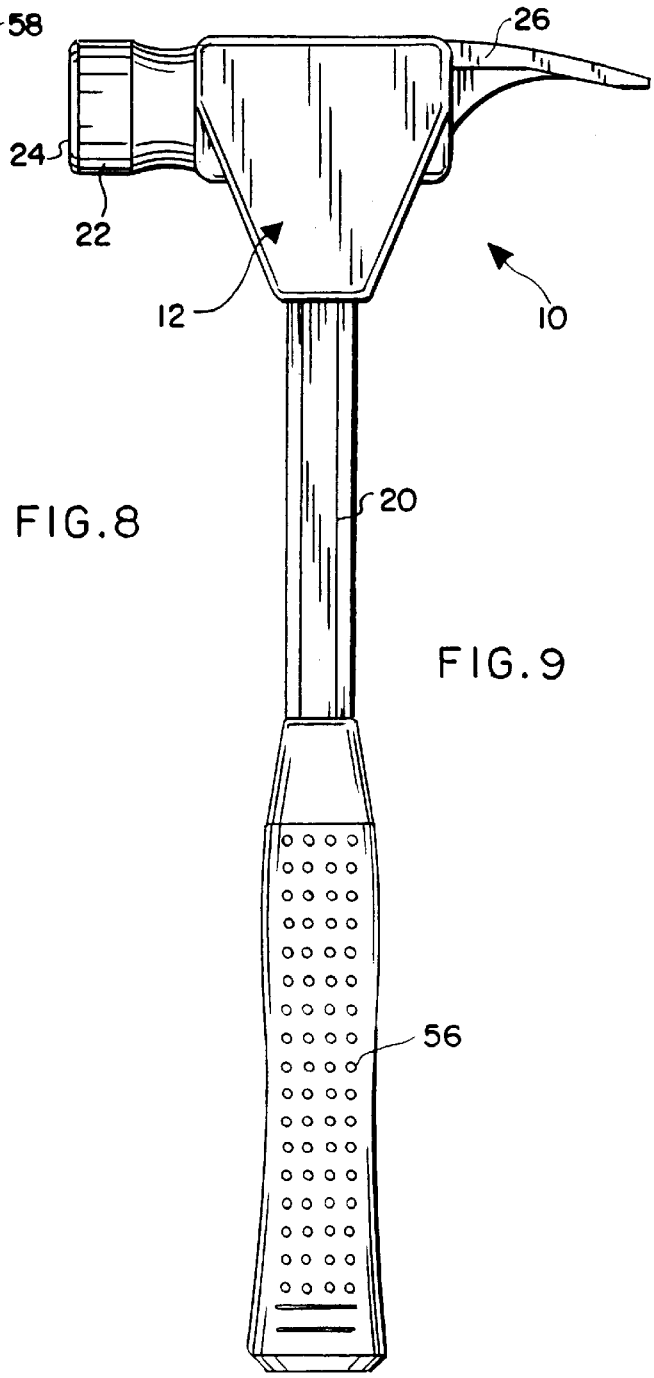
FIG. 9 is a side elevational view of the improved nonrecoil hammer constructed according to the present invention.

As shown in the exemplary drawings, an improved nonrecoil or deadblow hammer referred to generally in FIGS. 7–9 by the reference numeral 10 includes a tool head 12 of the type formed from a hard and preferably metal material such as hardened steel. This tool head 12 has an open socket 14 (FIG. 7) formed therein to receive and contain a relatively high mass flowable filler material 16 (FIG. 8), such as steel shot pellets or the like, to provide the hammer 10 with substantial nonrecoil or deadblow characteristics during normal use. In the preferred form, and in accordance with a preferred method of assembly, the flowable filler material 16 is contained within a hollow canister 18 (FIGS. 7 and 8) which is preassembled with a tool handle 20, followed by seated fitting of the canister 18 into the socket 14 formed in the hard metal tool head 12.

The improved hammer 10 of the present invention is designed for use the broad range of manually operated impact tool tasks wherein a hard metal tool head is preferred or required, and further wherein potential marking or damage to a target surface in response to impact blows is not a significant concern. In this regard, the illustrative drawings show the tool head 12 in a geometry to include front and rear work members in the form of a front impact member 22 defining a hard-surfaced impact face 24, and a rear cleft-shaped nail removal claw 26, in conformance with the construction of a conventional so-called carpenter's framing hammer. Such framing hammer desirably includes the front impact member 22 and the rear claw 26 of relatively hard steel for performing a range of tasks such as nail driving and nail pulling. In addition, in a hammer of this type, it is also desirable for the remainder of the tool head 12 to be constructed from a rigid and hard material such as a hardened steel body formed integrally with the front and rear work members 22, 26 so that the hammer can also be used for a variety of other tasks, including but not limited to wedging, prying, etc. The present invention provides the improved hammer 10 with all of these desirable characteristics, but in addition provides the hammer with beneficial nonrecoil or deadblow characteristics for improved delivery of the energy of an impact blow to a target surface with reduced hammer rebound and resultant reduced worker fatigue.

The tool head 12 is shown in FIGS. 4–7 to include a central body 28 having the front impact member 22 and the rear nail removal claw 26 formed at opposite ends thereof. In the preferred construction, the tool head 12 is formed as a unitary metal structure, preferably from a hardened steel. The central body 28 has the socket 14 formed therein with an upwardly open configuration. As shown best in FIGS. 5 and 6, this socket 14 comprises a relatively large and upwardly open cavity of generally rectangular shape lined by upstanding front and rear end walls 30 and 32, and by a pair of upstanding side walls 34. The front and rear end walls 30, 32 are disposed generally in axial alignment with and thus define inboard end walls for the front and rear work members 22, 26 of the hammer.

The base or lower end of the socket 14 is defined by a peripheral rim 36 extending inwardly from the lower ends of the end walls 30, 32 and the adjoining side walls 34. This peripheral rim 36 defines a support surface for seated and secure nested reception of the canister 28, as will be described in more detail. The rim 36 merges in turn with a downwardly open handle port 38 defined in the illustrative drawings by a downwardly extending hollow skirt 40 of generally truncated conical shape formed as part of the tool head 12 in substantial alignment with a vertical center axis of the overlying socket 14. The cross sectional area defined by the handle port 38 is significantly smaller than the cross sectional area defined by the open upper or top end of the socket 14.

As shown in FIGS. 1–3 and 8, the canister 18 comprises a generally rectangular hollow case or core having a size and shape for nested and substantially mated reception into the socket 14 of the tool head 12. More specifically, the canister 18 may be formed from a suitable sturdy material such as a selected metal or molded plastic, to have a hollow interior 42 (FIG. 3) and initially to include at least one opening such as an open front end 44 (FIGS. 3 and 8) to permit partial filling of the canister with the relatively high mass flowable filler material 16, e.g., metal shot pellets or pins or the like. After placement of the filler material 16 into the canister 18, the opening 44 is closed, as by means of an end plate 46 suitably affixed over or nested within the canister front end. Importantly, the canister 18 is sized and shape to fit relatively tightly within the socket 14 as viewed in FIG. 8, with the front end plate 46 abutting the adjacent inboard front end wall 30 of the tool head, and with a rear end face 48 of the canister abutting the adjacent inboard rear end wall 32 of the tool head 12. In this regard, the front and rear end walls 30, 32 of the tool head 12 will normally be formed with a slight taper or draft extending upwardly and outwardly relative to the socket 14, and the front and rear faces 46, 48 of the assembled canister 18 will be formed with a mating taper or draft for tight abutting fit against the end walls 30, 32. A similar taper may be imparted to the socket side walls 34, in which case the side walls 50 of the canister 18 would be formed with a mating taper for tight abutting fit therewith.

A lower or bottom wall 52 of the canister 18 seats upon the peripheral rim 36 within the socket 14, when the canister is fully and properly inserted into the socket 14 as viewed in FIG. 8. In this position, a tapered stem 54 of truncated conical shape extends downwardly from the underside of the canister bottom wall 52, within the tool head skirt 40. This tapered stem 54 comprises a convenient structure for connection of the canister 18 to an upper end of the tool handle 20, wherein this connection is protectively located within and surrounded by the skirt 40, as shown best in FIG. 8. The tool handle 20 extends downwardly from the canister stem 54, through the handle port 38 defined by the skirt 40, for convenient manual grasping during hammer use. A resilient grip 56 (FIG. 9) may be mounted on a lower region of the tool handle 20.

In accordance with a preferred method of producing the improved hammer 10 of the present invention, the canister 18 is initially preassembled with the tool handle 20. In this regard, in the case of a metal canister structure, the canister stem 54 can be securely attached to the upper end of a metal tool handle by means of welding or the like, as a connection point indicated by reference numeral 58 (FIGS. 1–3 and 8). Alternately, in one preferred form utilizing a fiberglass tool handle 20 which may be constructed as by pultrusion according to U.S. Pat. Nos. 5,262,113 and 5,375,486, which are incorporated by reference herein, the canister 18 may be assembled with the tool handle 20 and encased in whole or in part within a suitable thermoplastic molded cladding (not shown). In such configuration, the molded cladding would normally leave the end faces 46, 48 of the canister unexposed for subsequent intimate abutting engagement with the inboard end walls 30, 32 lining the tool head socket 14. In either construction, the flowable filler material 16 is placed into the hollow canister 18 prior to or following canister attachment to the tool handle 20, and the canister 18 is closed by means of the end plate 46 to seal the filler material therein.

The preassembled canister 18 and tool handle 20 are then assembled with the tool head 12 by sliding the handle 20 downwardly through the handle port 38 (FIG. 7) until the canister 18 is fully seated within the socket 14 (FIG. 8). In the fully seated position, the periphery of the canister bottom wall 52 is firmly seated upon the support rim 36 at the bottom of the socket 14, and the opposing end faces 46, 48 of the canister are is relatively tight and intimate abutting engagement with the inboard end walls 30, 32 lining the socket. In addition, a lower end of the skirt 40 is sized and shaped for relatively snug-fit sliding reception and support of the handle 20. A cap plate 60 (FIGS. 7 and 8) is then secured to the top of the tool head 12, as by welding or by use of a suitable adhesive material, to close the upper end of the socket 14 and thereby enclose the canister therein. The resilient hand grip 56 can then be mounted onto the lower region of the tool handle 20, if desired.

In use, the hammer 10 can be employed by a worker to perform any of the traditional impact, prying, etc., functions normally associated with a conventional carpenter's framing hammer. Upon striking an impact blow by swinging the front impact member 22 against a target surface, such as the head of a nail, the flowable filler material 16 within the tool head shifts in the direction of the blow at the moment of impact to focus the impact energy upon the target surface. As a result, little energy is available for causing any significant recoil or rebound of the hammer from the target surface following the impact blow. Accordingly, by applying an increased proportion of the impact energy to the target surface for each blow, the improved hammer of the present invention is beneficially capable of performing tasks with a reduced effort, either in terms of the number of blows or in terms of the force of each blow, in comparison with a conventional solid steel tool head hammer of comparable weight. Alternatively, the improved hammer of the present invention permits a hammer of lighter weight to be used. Moreover, the nonrecoil characteristics of the hammer 10 result in further reductions in worker effort and fatigue. Importantly, the hollow canister 18 is supported by the tool head 12 in a secure and stable manner, by virtue of the snug nested fit within the socket 14, in combination with the secondary support provided by the skirt 40 engaging the handle 20 at a point below the canister/handle connection site 58.

A variety of further modifications and improvements in and to the nonrecoil hammer of the present invention will be apparent to those persons skilled in the art. Accordingly, no limitation on the invention is intended by way of the foregoing description and accompanying drawings, except as set forth in the appended claims.

What is claimed is:

1. A nonrecoil hammer, comprising:

a metal tool head defining at least one impact member and including a central body having an open socket formed therein;

a flowable filler material of relatively high mass contained within and partially filling said tool head socket; and a handle coupled to said tool head and extending downwardly therefrom;

wherein said open socket is upwardly open within said central body of said tool head, said socket being lined by a lower support surface joined to a pair of generally upstanding opposed end walls and a pair of generally upstanding opposed side walls, and further including a hollow canister having said flowable filler material contained therein seated within said socket in nested relation with said lower support surface and said opposed end walls.

2. The nonrecoil hammer of claim 1 wherein said metal tool head comprises a steel tool head.

3. The nonrecoil hammer of claim 1 wherein said at least one impact member comprises a pair of front and rear work members disposed generally at opposite front and rear ends of said central body.

4. The nonrecoil hammer of claim 3 wherein said front and rear work members respectively comprise a front impact member defining a front impact face, and a rear nail removal claw.

5. The nonrecoil hammer of claim 1 further including means for closing said open socket to contain said flowable filler material therein.

6. The nonrecoil hammer of claim 1 wherein said flowable filler material comprises steel pellets.

7. The nonrecoil hammer of claim 1 wherein said lower support surface lining said socket defines a downwardly open handle port, said handle being connected to said canister and extending therefrom through said handle port and downwardly from said tool head.

8. The nonrecoil hammer of claim 7 wherein said tool head further includes a hollow skirt extending downwardly from said socket and surrounding an upper end of said handle, said skirt having a lower end with a size and shape for relatively snug-fit sliding reception of said handle.

9. The nonrecoil hammer of claim 1 wherein said canister defines a pair of end faces at opposite ends thereof for tight abutting engagement respectively with said opposed end walls lining said socket, when said canister is nested within said socket.

10. The nonrecoil hammer of claim 1 further including a cap plate mounted on said tool head for enclosing said canister within said socket.

11. The nonrecoil hammer of claim 1 further including a resilient hand grip mounted on a lower region of said handle.

12. A nonrecoil hammer, comprising:

a metal tool head including a central body having an upwardly open socket formed therein and further defining at least one impact member formed on a front end of said central body, said open socket being lined by a pair of generally upstanding front and rear end walls joined to a pair of generally upstanding opposed side walls, and further including an upwardly presented support surface at a lower end of said socket, said support surface having a handle port formed therein;

a hollow canister having a size and shape for nested reception into said socket, seated upon said support surface and including front and rear end faces on said canister for relatively tight and substantially mating abutted fit respectively with said front and rear end walls lining said socket;

a flowable filler material of relatively high mass contained within and partially filling said canister; and a handle coupled to said canister and extending downwardly from said canister and through said handle port when said canister is nested within said socket.

13. The nonrecoil hammer of claim 12 wherein said metal tool head comprises a steel tool head.

14. The nonrecoil hammer of claim 12 wherein said tool head further includes a rear work member formed on a rear end of said central body generally in alignment with said impact member, said front and rear end walls within said socket being disposed generally in alignment with said impact member and said rear work member.

15. The nonrecoil hammer of claim 14 wherein said impact member and said rear work member respectively comprise a front impact member defining a front impact face, and a rear nail removal claw.

16. The nonrecoil hammer of claim 12 further including means for closing said open socket to contain said canister therein.

17. The nonrecoil hammer of claim 12 wherein said tool head further includes a hollow skirt extending downwardly from said socket and surrounding an upper end of said handle, said skirt having a lower end with a size and shape for relatively snug-fit sliding reception of said handle.

18. A method of making a nonrecoil hammer, comprising the steps of:

providing a metal tool head defining at least one impact member and including a central body having an open socket formed therein, wherein the open socket is upwardly open within the central body of the tool head, said socket being lined by a lower support surface joined to a pair of generally upstanding opposed end walls and a pair of generally upstanding opposed side walls;

nesting a hollow canister having the flowable filler material contained therein in a position seated within the socket;

partially filling the socket with a flowable filler material of relatively high mass; and coupling a handle to the tool head to extend downwardly therefrom.

19. The method of claim 18 wherein the metal tool head comprises a steel tool head.

20. The method of claim 18 wherein the tool head the at least one impact member comprises a pair of front and rear work members disposed generally at opposite front and rear ends of the central body.

21. The method of claim 20 wherein the front and rear work members respectively comprise a front impact member defining a front impact face, and a rear nail removal claw.

22. The method of claim 18 further including the step of closing the open socket to contain the flowable filler material therein.

23. The method of claim 18 wherein the lower support surface lining said socket defines a downwardly open handle port, and further including the step of connecting the handle to the canister to extend therefrom through the handle port and downwardly from the tool head.

24. The method of claim 23 wherein the tool head further includes a hollow skirt extending downwardly from the socket and surrounding an upper end of the handle, the skirt having a lower end with a size and shape for relatively snug-fit sliding reception of the handle.

25. The method of claim 18 wherein the canister defines a pair of end faces at opposite ends thereof for tight abutting engagement respectively with the opposed end walls lining the socket, when the canister is nested within the socket.

26. The method of claim 18 further including the step of mounting a cap plate on the tool head for enclosing the canister within the socket.

27. The method of claim 18 further including the step of mounting a resilient hand grip mounted on a lower region of the handle.

28. A method of making a nonrecoil hammer, comprising the steps of:

providing a metal tool head including a central body having an upwardly open socket formed therein and further defining at least one impact member formed on a front end of the central body, said open socket being lined by a pair of generally upstanding front and rear end walls joined to a pair of generally upstanding opposed side walls, and further including an upwardly presented support surface at a lower end of said socket, said support surface having a handle port formed therein;

partially filling a hollow canister with a relatively high mass flowable filler material, said hollow canister having a size and shape for nested reception into the socket, seated upon the support surface and including front and rear end faces on the canister for relatively tight and substantially mating abutted fit respectively with the front and rear end walls lining the socket;

coupling a handle to the canister; and slidably fitting the handle through the handle port to extend downwardly from the tool head while nestably fitting the canister within the socket.

29. The method of claim 28 wherein the tool head further includes a rear work member formed on a rear end of the central body generally in alignment with the impact member, said front and rear end walls within the socket being disposed generally in alignment with the impact member and the rear work member.

30. The method of claim 29 wherein the impact member and the rear work member respectively comprise a front impact member defining a front impact face, and a rear nail removal claw.

31. The method of claim 28 further including the step of closing the open socket to contain the canister therein.

32. The method of claim 28 wherein the tool head further includes a hollow skirt extending downwardly from the socket and surrounding an upper end of the handle, said skirt having a lower end with a size and shape for relatively snug-fit sliding reception of the handle.

* * * * *

UNITED STATES PATENT AND TRADEMARK OFFICE

CERTIFICATE OF CORRECTION

PATENT NO. : 6,227,075 B1
DATED : May 8, 2001
INVENTOR(S) : Joseph Allen Carmien It is certified that error appears in the above-identified patent and that said Letters Patent is hereby corrected as shown below:

Claim 20,
Line 15, after the word head, replace "the" with -- and --

Signed and Sealed this

Fifth Day of March, 2002

*Attest:*

*Attesting Officer*

JAMES E. ROGAN
*Director of the United States Patent and Trademark Office*